US006104996A

United States Patent [19]

Yin

[11] Patent Number: 6,104,996

[45] Date of Patent: Aug. 15, 2000

[54] AUDIO CODING WITH LOW-ORDER ADAPTIVE PREDICTION OF TRANSIENTS

[75] Inventor: Lin Yin, San Jose, Calif.

[73] Assignee: Nokia Mobile Phones Limited, Espoo, Finland

[21] Appl. No.: 08/940,677

[22] Filed: Sep. 30, 1997

[30] Foreign Application Priority Data

Oct. 1, 1996 [GB] United Kingdom ..... 9620457

[51] Int. Cl.[7] ..... G10L 19/04

[52] U.S. Cl. ..... 704/500; 704/219

[58] Field of Search ..... 704/220, 219, 704/229, 500

[56] References Cited

U.S. PATENT DOCUMENTS

| | | | |
|---|---|---|---|
| 4,301,329 | 11/1981 | Taguchi | 704/217 |
| 5,321,793 | 6/1994 | Drogo De Iacovo et al. | 704/220 |
| 5,339,384 | 8/1994 | Chen | 704/211 |
| 5,511,093 | 4/1996 | Edler et al. | 375/240 |
| 5,515,397 | 5/1996 | Wiorek | 375/216 |
| 5,557,639 | 9/1996 | Heikkila et al. | 375/224 |
| 5,596,677 | 1/1997 | Jarvinen et al. | 704/220 |

FOREIGN PATENT DOCUMENTS

| | | |
|---|---|---|
| 0532225 A2 | 3/1993 | European Pat. Off. . |
| 0573398 A2 | 12/1993 | European Pat. Off. . |
| 0599569 A2 | 6/1994 | European Pat. Off. . |
| WO 95/28824 | 11/1995 | WIPO . |

OTHER PUBLICATIONS

"Transform Coding Of Audio Signals Using Correlation Between Successive Transform Blocks", Mahieux et al., Proc. ICASSP, 1989, pp. 2021–2024.

"A Differential Perceptual Audio Coding Method With Reduced Bitrate Requirements", Paraskevas et al, IEEE Transactions on Speech And Audio Processing, vol. 3, No. 6, Nov. 1995.

"Improving MPEG Audio Coding By Backward Adaptive Linear Stereo Prediction", Fuchs et al., AES Convention, N.Y., Preprint No. 4086 Oct. 1995.

"A Fixed–Point 16kb/s LD–CELP Algorithm", Chen et al., Proc. ICASSP, pp. 21–24, 1991.

*Primary Examiner*—David R. Hudspeth
*Assistant Examiner*—Donald L. Storm
*Attorney, Agent, or Firm*—Perman & Green, LLP

[57] ABSTRACT

An encoder comprising predictive coding means for encoding electronic signals input thereto is disclosed. The predictive coding means is adapted to operate in a first high prediction order mode and in a second lower prediction order mode. The predictive coding means operates in the first and second modes in dependence on an input electronic signal comprising a transient signal. Preferably, the second mode comprises a transient recovery sequence of prediction orders. The transient signal detector determines predictive coding gain as well as a difference in predictive coding gain for a sequential input signal exceeding a threshold. The prediction orders are gradually increased for subsequent signals until the first mode (high) prediction order is attained. A transmission of electronics signals provides for an indication of initiation of a second mode for the predictive coding. Circuitry is included for reception of the second mode initiate signal. There is also disclosed a decoder for decoding signals encoded by the encoder.

20 Claims, 7 Drawing Sheets

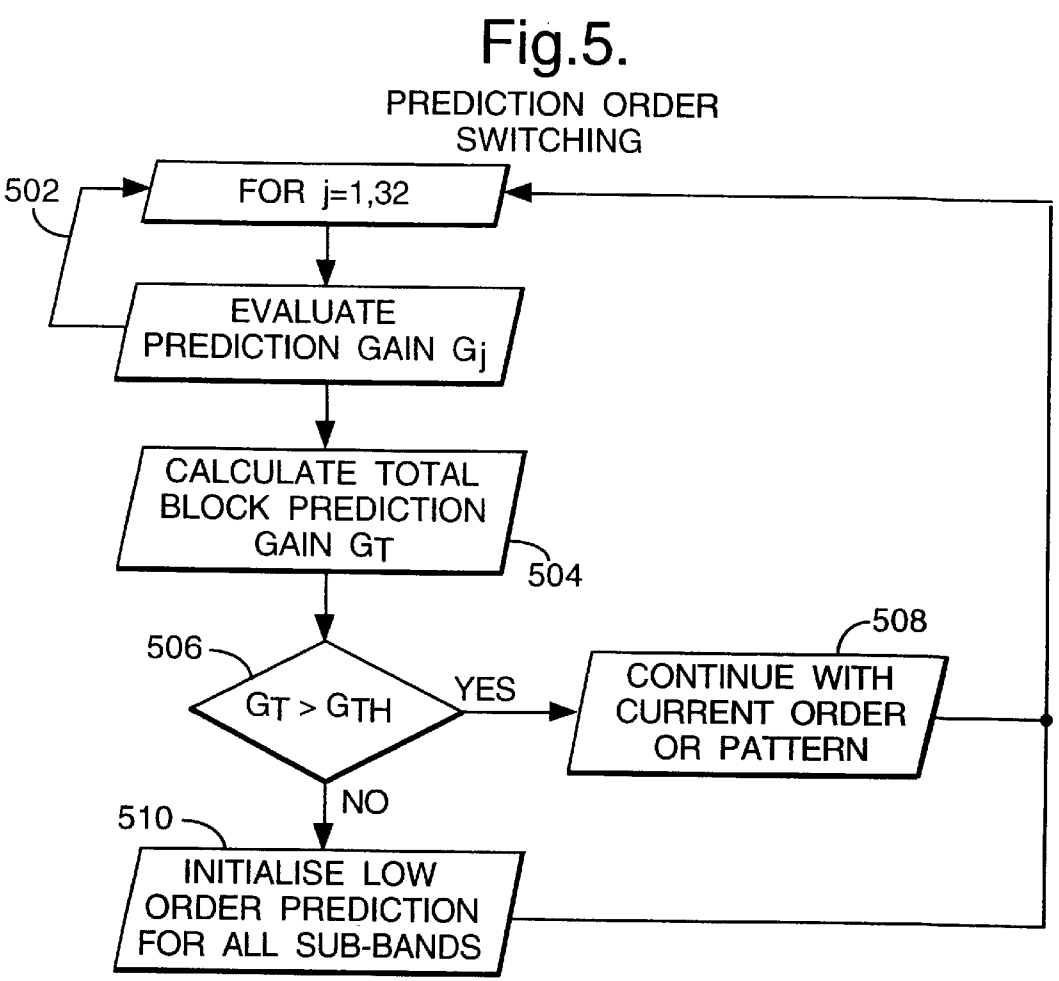
Fig.5.
PREDICTION ORDER SWITCHING
FOR j=1,32
502
EVALUATE PREDICTION GAIN Gj
CALCULATE TOTAL BLOCK PREDICTION GAIN GT
504
GT > GTH
506
YES
NO
CONTINUE WITH CURRENT ORDER OR PATTERN
508
INITIALISE LOW ORDER PREDICTION FOR ALL SUB-BANDS
510

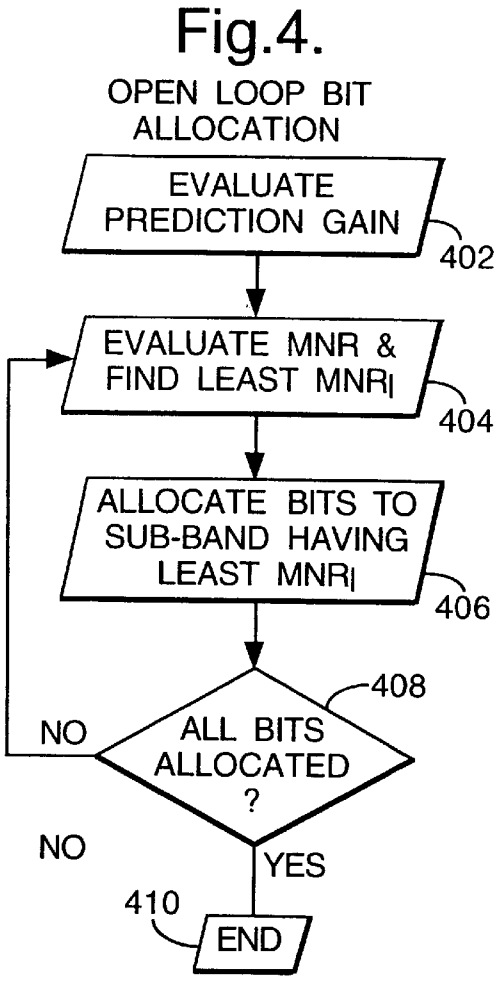
Fig.4.
OPEN LOOP BIT ALLOCATION
EVALUATE PREDICTION GAIN
402
EVALUATE MNR & FIND LEAST MNR|
404
ALLOCATE BITS TO SUB-BAND HAVING LEAST MNR|
406
ALL BITS ALLOCATED ?
408
NO
YES
END
410

LOW-ORDER PREDICTION SUB-ROUTINE 510

TABLE 1: PREDICTOR PATTER AFTER TRANSIENTS

| NUM_FRAME | ORDER | DATA LENGTH |
|---|---|---|
| 1 | 20 | 48 |
| 2 | 20 | 48 |
| 3 | 20 | 48 |
| 4 | 20 | 48 |
| 5 | 40 | 60 |
| 6 | 40 | 72 |
| 7 | 40 | 84 |
| 8 | 40 | 96 |
| 9 | 50 | RECURSIVE LD-CELP ALGORITHM |

AUDIO CODING WITH LOW-ORDER ADAPTIVE PREDICTION OF TRANSIENTS

FIELD OF INVENTION

This invention relates to a method for audio coding and decoding electronic signals, and to apparatus for such method.

BACKGROUND TO INVENTION

In order to transmit audio signals such as speech or music via digital transmission systems, the signals must first be digitised. That is to say, the audio signal must be represented in digital form. A simple form of digital representation is Pulse Code Modulation (PCM). In PCM the amplitude of an audio signal is sampled at discrete time intervals, and each amplitude sample is represented as a digital word. However, since a digital word can only represent discrete levels, for example 32 levels for a 5 bit digital word, each amplitude sample is quantised to one of these 32 levels. This results in there being a difference between the sampled signal and the actual digital sample values. The difference is known as the quantisation error since it arises out of the quantisation process.

The minimum rate at which a signal needs to be sampled in order to be correctly represented is twice the frequency of the highest frequency component in the signal. This is known as the Nyquist rate. For human audio applications the Nyquist rate is typically 20–24 KHz.

To achieve acceptable quantisation noise levels for typical human audio a 700 kbps data rate is conventionally used. Such a data rate requires wide band transmission channels, which are expensive or hard to obtain. This is a particular problem in radio or wireless communication channels where the bandwidth of communication channels are a trade off between data rate requirements, available spectrum and compatibility with Integrated Digital Services Networks (ISDN) or other land line communication system. Typically, the available data rate is 64 kbps. Additionally, wire or cable links comprising both audio and video channels may have limited available bandwidth, in order to accommodate all the channels.

Since the storage and transmission of high quality audio data can be technically or economically prohibitive in many applications, particularly consumer applications, and existing communication channels such as for ISDN are limited to low bit rates (64 kbps), efficient bit rate reduction techniques are necessary. Bit rate reduction is achieved by compressing the signal in some manner.

There are two basic principles of signal compression: removing the statistical or deterministic redundancies in the source signal; and matching the quantising system (PCM) to the properties of human perception. In compressing audio signals, redundancy in the signal is reduced as much as possible using prediction and transform coding techniques. Perceptual coding (noise shaping) techniques, based on human audio perception are also used to reduce redundancy.

During the last few years, the approach most suited for achieving the required data compression for high quality audio applications has utilised the masking properties of the human auditory system. This approach uses filterbanks or transform coding to separate audio signals into frequency bands (sub-bands). Each sub-band is analysed and data irrelevancy is removed from acoustic signals without any noticeable effect to the listener. The masking properties are psychoacoustical in that the masking mechanism occurs in the inner ear and results in noise components being inaudible provided that they coexist with other components of stronger amplitude. Audio coders utilise this phenomenon and shape quantisation noise components to be below a masking threshold of the signal. The ISO (International Standards Organisation) MPEG (Moving Pictures Expert Group) audio coding standard and other audio coding standard were developed based on the above principles.

For further reductions in data rate, e.g. down to 64 kbps, additional coding techniques are necessary. Some of such coding techniques are based on adaptive prediction. Adaptive prediction is based on using previous signal samples to predict what a current sample will be, and comparing the predicted value with the current sample value to determine a difference or error between them. The error signal is then transmitted together with coefficients, or without coefficients for backward prediction, representing the predicted signal, such that the sample can be reconstructed at a decoder. The number of bits that need to be transmitted using predictive coding is substantially less than required for the original signals. This gives what is known as a "coding gain". This is the reduction in transmitted signal power for coded signals compared to the transmitted signal power required for original signals.

It is known to use backward linear prediction techniques for decreasing the redundancy of audio signals. Mahieux et al, "Transform Coding of Audio Using Correlation Between Successive Transform Blocks" Proc ICASSP '89 pp 2021–2024 describes using a fixed linear predictor to remove inter-frame redundancy. Also, techniques have been described in which only audible differences between successive frames are encoded, Paraskevas et al, "A Differential Perceptual Audio Coding Method With Reduced Bitrate Requirements", IEEE Trans. on Speech and Audio Processing, vol. 3 No. 6 November 1995.

Due to the non-stationary nature of audio signals, particularly music audio, adaptive predictive coding techniques have been used. Fuchs et al, "Improving MPEG Audio Coding by Backward Adaptive Linear Stereo Prediction", AES convention, New York, Preprint No 40 86 October 1995, describes a lattice structured adaptive predictor using predictor switching of different orders applied to an MPEG audio codec. However, these methods had drawbacks and problems such as instability and slow convergence after switch on or recovery from transients. Additionally, side information needs to be transmitted to indicate which predictor order is in use. The level of side information transmitted depends on the number of predictors with different prediction orders, and the number of transmitted sub-bands. Fuchs et al used seven predictors requiring four bits of side information. For 20 sub-bands having non-zero bit allocation this results in 80 bits per frame or 10 kbit/s for MPEG-1 Layer 1 and 3.3 kbit/s for MPEG-1 Layer II. Such bit rates are negligible for a high bit rate audio codec, but have a severe impact on low bit rate codecs.

BRIEF SUMMARY OF THE INVENTION

In a first aspect in accordance with an embodiment of the invention there is provided an encoder comprising, predictive coding means for encoding electronic signals input thereto, the predictive coding means being operable for a first high prediction order mode and for a second lower prediction order mode, wherein the predictive coding means is operable for the first and second modes in dependence on an input electronic signal comprising a transient signal.

In a second aspect in accordance with an embodiment of the invention there is provided a decoder comprising, predictive coding means for decoding electronic signals input thereto, the predictive coding means being operable for a first high prediction order mode and for a second lower prediction order mode, wherein the predictive coding means is operable for the first and second modes responsive to a second mode initiate signal input thereto.

In a third aspect in accordance with an embodiment of the invention there is provided a method for encoding electronic signals, comprising predictive coding input electronic signals in a first mode having a high prediction order, detecting an input electronic signal comprising a transient signal, and initiating predictive coding input electronic signals in a second mode having a lower prediction order for detection of an input electronic signal comprising a transient signal; and in a fourth aspect in accordance with an embodiment of the invention there is provided a method for decoding electronic signals, comprising predictive coding input electronic signals in a first mode having a high prediction order, detecting a second mode initiate signal, and initiating predictive coding of input electronic signals in a second mode having a lower prediction order in response to the second mode initiate signal.

An advantage of an embodiment of the invention is that relatively high prediction gain may be achieved since high order backward predicters can be used. Compared to conventional adaptive algorithms, a block processed algorithm for finding backward predictors leads to relatively stable predictors even when transient signals are to be encoded or decoded. By utilising low order predictors in the second mode for transients, greater overall prediction gain may be achieved than otherwise attainable with high order predictors during transients. This may be achieved by the second mode comprising a transient recovery sequence in order to relatively quickly stabilise the predictor after a transient signal. Additionally, an embodiment in accordance with the present invention merely requires a single bit to indicate whether or not high or low order prediction is to be used.

In a preferred embodiment the predictive coding means is selectable to initiate the second mode for the input electronic signal comprising a transient signal or for decoding when the second mode initiates signal is input to the predictive coding means.

Preferably, the predictive coding means is adapted in the second mode to be operative at a first low prediction order for the input electronic signal and subsequently increasingly higher prediction orders for subsequent input electronic signals. This provides greater prediction gains than obtainable with high order prediction after a transient signal has occurred, and may be achieved by a transient recovery sequence which quickly stabilises the predictor after the transient. Advantageously the prediction order is increased up to the first high prediction order. This leaves the transient signal recovery sequence at the high order prediction level ready to continue at the high order prediction level. In this way, the predictive coding means is further adapted such that the first mode becomes operative for the prediction order in the second mode being the first high prediction order.

Typically, the encoder further comprises transient signal detection means. The transient signal detection means may be adapted to determine a difference in predictive coding gain for sequential input electronic signals exceeding a predetermined threshold. Optionally, the transient signal detection means may be adapted to determine predictive coding gain exceeding a predetermined threshold.

Optionally, transients may be determined in other ways, for example, comparing the signal powers of a first half frame and a second half frame. If the signal powers are very different, this frame may be detected as a transient. Additionally, psycho-acoustic models can also be used to detect transients. A particular advantage of the present means of transient signal detection is that it utilises coding gain which is a parameter which is typically calculated during the implementation of predictive coding.

Suitably the encoder and decoder further comprise filtering means for either providing electronic signals categorised into respective sub-bands to corresponding respective predictive coding means, or providing composite electronic signals from respective sub-band signals originating from respective predictive coding means.

There is generally provided a transmitter which comprises an encoder in accordance with an embodiment of the invention and further comprising means for transmitting electronic signals indicating the initiation of the second mode for the predictive coding means. Also, there is generally provided a receiver comprising a decoder in accordance with the present invention and further comprising means for receiving the second mode initiate signal.

BRIEF DESCRIPTION OF THE DRAWINGS

FIG. 4 shows a flow chart for open loop bit allocation;

FIG. 5 shows a flow chart for prediction order switching;

DETAILED DESCRIPTION OF EMBODIMENTS OF THE INVENTION

There will now be described specific embodiments in accordance with the invention, by way of example only, and with reference to the accompanying drawings.

Figure 1:
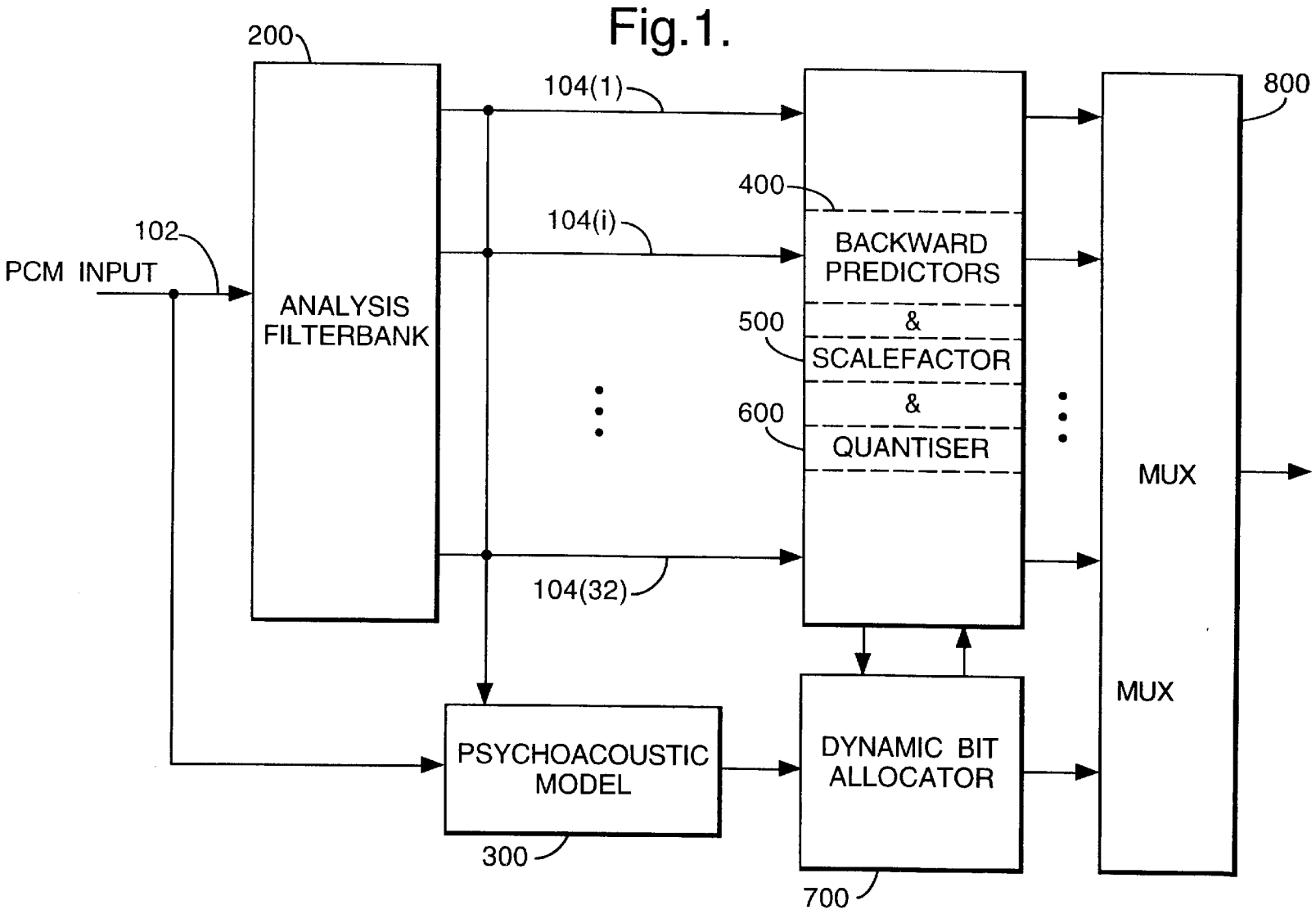
FIG. 1 shows a block diagram of an embodiment in accordance with the invention.

An embodiment in accordance with the invention is shown in FIG. 1. In FIG. 1 there is shown a block diagram of a perceptual audio encoder with backward linear predictors, suitable for use with MPEG 1 algorithms.

Pulse Code Modulated (PCM) audio stream 102 is input to a filter 200 for dividing the input audio stream 102 into 32 frequency sub-bands 104 (1 . . . 32). It will be evident to a person skilled in the art that the input audio stream may be divided into a different number of frequency sub-bands. 32 sub-bands are described here in relation to MPEG-1. Simultaneously audio stream 102 is input to a psychoacoustic model 300 for determining the ratio of signal energy to the masking threshold for each sub-band 104. The filter 200 may comprise any suitable filter such as a filter bank, micro processor or signal processing circuitry adapted to perform a Modified Discrete Cosine Transform (MDCT) or Fourier Transform for example, for providing means to filter audio stream 102. Sub-band samples 104(*j*) of the audio stream 102 are input to respective backward linear predictors 400, also comprising Scalefactors 500, Quantizers 600 and Predictor Switch 900 circuitry, and to Psychoacoustic Model 300. Sub-band samples 104(*j*) are grouped together in frames of 12 samples for respective sub-bands, and the predictive coding is carried out on a frame by frame basis. Again, there need not be 12 samples but any number of samples suitable for the application for which the present invention is utilised.

Psychoacoustic Model 300 outputs so called mask-to-noise ratios (MNR) for each sub-band to a Dynamic Bit Allocator (DBA) 700. The DBA 700 also has input to it signal-to-noise ratios (SNR) for each sub-band from Quantizer 600 for determining the apportioning of code bits for representing quantised samples and formulating this data and side information into a coded bitstream. Scale factor 500 normalises respective sub-band samples 104(*j*) to the largest amplitude in each block of sub-band sample 104(*j*).

Encoded signals for each sub-band are then input to Multiplexor 800 where they are multiplexed together with the bit allocation information into serial data form by frame packing for example into MPEG format.

Figure 2:
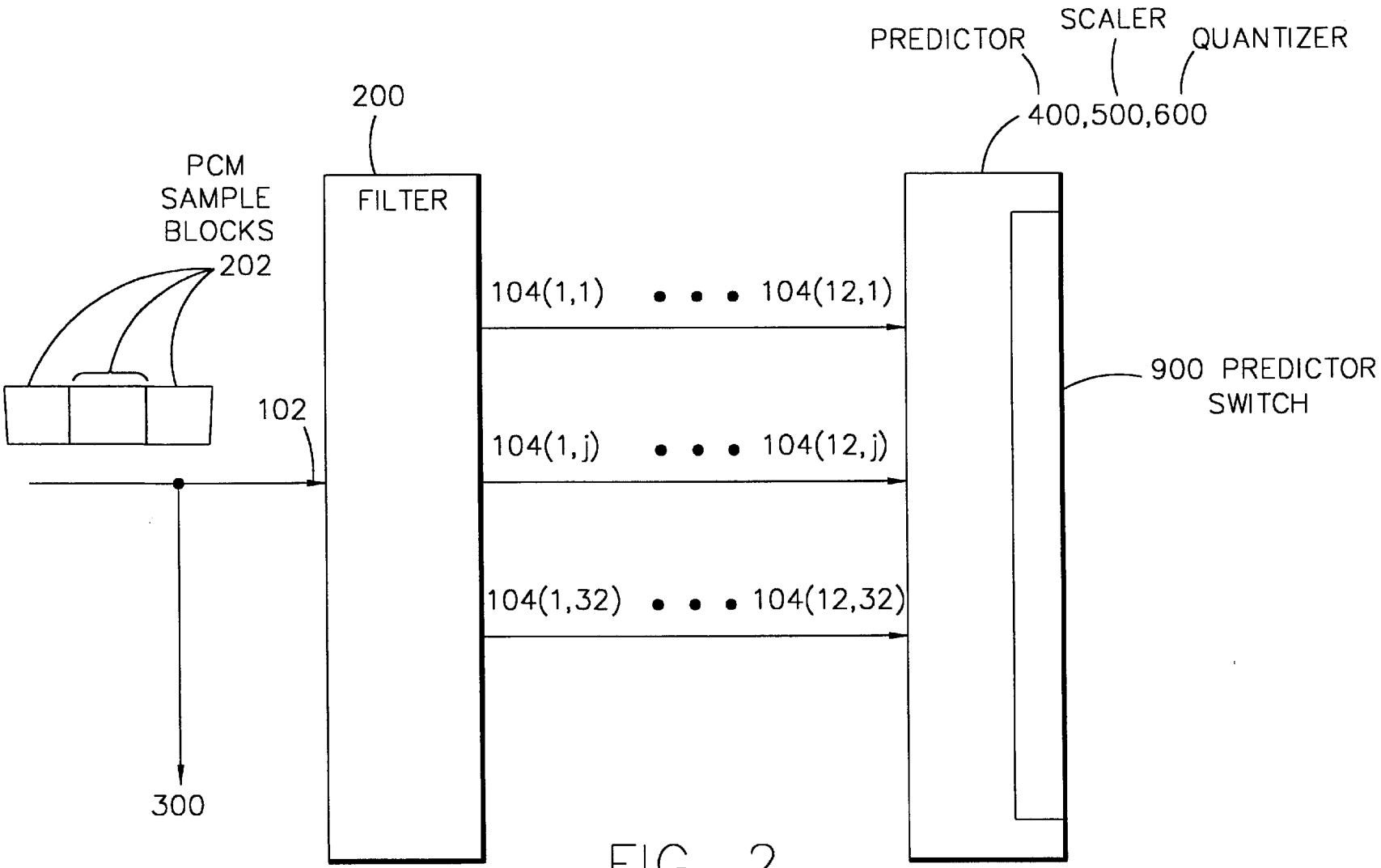
FIG. 2 shows a block diagram of a filter bank suitable for providing signals for predictive coding in accordance with the present invention.

Referring now to FIG. 2, the audio input stream 102 comprises frames or blocks 202 of PCM samples. Typically for audio applications the PCM samples each comprise 16 to 24 bits. Audio input stream 102 is input to filter 200 and psychoacoustic model 300. Filter 200 transforms audio stream 102 frame by frame, from the time domain into the frequency domain. As mentioned earlier, filter 200 may comprise a filterbank, MDCT, Fourier Transform or any other suitable transform. In the described embodiment the audio stream is transformed into 32 sub-band frequencies of the typical human audio range (up to 24 KHz). For each frame 202 of input audio 102 a single sub-band value 104(*j*) is output from filter 200. The sub-band values are grouped together in frames of 12 before being processed by Backward Predictors 400, Scale factor 500 and Quantizer 600. Thus, filter 200 inputs a 12×32 sub-band sample matrix to Backward Predictors 400.

In Backward Predictors 400 there is provided a backward Linear Predictor 400; Scale factor 500; and Quantiser 600; for each sub-band. For a jth sub-band the input signal to the jth predictor is represented by $x_j(n)$. The output (predicted) signal and quantised signal are represented by $\hat{x}_j(n)$ and $\tilde{x}_j(n)$ respectively. The prediction error signal and quantised prediction error signal are represented by $e_j(n)$ and $\tilde{e}_j(n)$ respectively.

The predictor is represented by $c_j=[a_{j,1},a_{j,2}, \ldots ,a_{j,N}]^T$ which is time dependent i.e. adaptive. Coefficients "$a_j$" are the LPC coefficients for the jth sub-band, and the predictor has an order N. Typically, the predictor has an order of 50. The estimate or prediction of the current sample is calculated by $$\hat{x}_j(n) = c_j\tilde{x}_j(n)^T = \sum_{i=1}^{N} a_{j,i}\tilde{x}_j(n-i) \tag{1}$$

The predictor error and the quantised signal are $$e_j(n)=x_j(n)-\hat{x}_j(n), \tag{2}$$

$$\tilde{x}_j(n)=\hat{x}_j(n)+\tilde{e}_j(n) \tag{3}$$

Predictor $c_j$ can be expressed as $$c_j=R_j^{-1}r_j$$

where $R_j=E[\tilde{x}_j(n)\tilde{x}_j^T(n)]$ and $r_j=E[\tilde{x}_j(n)\tilde{x}_j(n)]$. This results in a prediction gain G, where, $$G_j = 10\log_{10}\frac{\sigma_{xj}^2}{\sigma_{ej}^2}\ \text{(dB)} \tag{4}$$

and $\sigma_{xj}^2=E[x_j^2(n)]$ and $\sigma_{ej}^2=E[e_j^2(n)]$.

Any suitable method for evaluating the LPC predictors for each frame may be used, for example, a Least Mean Squares (LMS) method, Recursive Least Squares (RLS) method, or block adaptive method.

In the described embodiment the LPC predictors "a" are updated once for each frame by performing LPC analysis on previously quantised sub-band signals. Updating once for each frame is valid since typically an audio signal is stationary over a frame.

For a quantised signal $\tilde{x}(n)$, the autocorrelations of the quantised signal are computed by $$r_j(k) = \sum_{n=k}^{L} \tilde{x}'_j(n)\tilde{x}'_j(n-k), \quad k = 0, \ldots, N \tag{5}$$

where $\tilde{x}_j'(n)$ is the windowed quantised signal and $$\tilde{x}_j'(n)=\tilde{x}_j(n)w(n) \tag{6}.$$

It will be evident to a person skilled in the art that any suitable window function may be used preferably one which is adapted to yield optimum results.

The described embodiment of the invention uses the recursive algorithm which was proposed for Low Delay-Code Excited Linear PredictionLD-CELP and described in Chen et al "A fixed-point 16 kb/s LD-CELP algorithm," Proc. ICASSP, pp.21–24, 1991, incorporated herein by reference. In LD-CELP, a hybrid window is used for estimating the autocorrelation functions. The window consists of a recursive decaying tail and a section of non-recursive samples at the beginning. The tail of the window is exponentially decaying with a decaying factor α slightly less than unity. The non-recursive part of the window is a section of a sine function, for example, the decay function α may be 0.9705 where the length of the non-recursive part is 100.

Each backward predictor produces a predicted signal $\hat{x}_j(n)$ given by equation (1) and a predictor gain $G_j$ given by equation (4)

In a conventional communication system utilising solely backward linear predictive coding for data compression error signal $e_j(n)$, given by equation (2), after typically undergoing error coding and channel coding, is transmitted to a receiver having a decoder with the same analysis algorithm as used in the Backward Predictor 400. The error signals $e_j(n)$ are channel decoded and error corrected, and input to the receiver analysis algorithm which produces a quantised signal $\tilde{x}_j(n)$ as given by equation (3). The predicted signal $\hat{x}_j(n)$ is produced in the receiver from previous quantised values using equation (1). In this manner a complete audio signal may be transmitted using just error signal $e_j(n)$ data, thereby using relatively low data rates.

Referring now to Psychoacoustic Model 300 shown in FIG. 1, both the PCM audio bit stream 102 and the output 104 from Filterbank 200 are input to the Psychacoustic Model 300. Psychoacoustic Model 300 utilises the fact that the presence of an auditory stimulus may be masked by the presence of another auditory stimulus. The masking effect may be a combination of the relative amplitudes and frequency of the stimuli, and even their chronological relationship. The net result is that certain auditory stimuli cannot be perceived by the human ear due to other auditory stimuli. Masking effects are used to develop psychoacoustic models for example ISO/IEC 11172-3 (MPEG 1 Audio), incorporated herein by reference, which in turn are used to analyse input audio to determine what components are masked by other components.

Psychoacoustic Model 300 determines the ratio of the signal energy to masking threshold energy for each sample or block in sub-band 104(*j*) to give a signal to mask ratio SMR(j) for each sub-band, utilising any suitable psychoacoustic model. In conventional perceptual audio coders, the masking properties of audio signals are utilised such that masked signals are not transmitted or the available bits for quantisation are allocated in such a way that quantisation or coding noise is masked.

Such control is based on the signal to mask ratio (SMR), and signal to noise ratio (SNR) for the sub-bands evaluated by a corresponding quantising unit. For example, in MPEG-1 Layer 1 and Layer II, SNR values remain fixed depending on the number of bits used for that sub-band and can be found in the tables given for each layer.

Referring now to FIG. 2, there is associated with Backward Predictors 400, Scalefactor 500 and Quantizer 600. Respective Scale Factor 500(*j*) and Quantiser 600(*j*) operate on respective prediction error blocks of sub-band samples $e_j(n)$ as given by equation (2).

By utilising prediction, SNR values may be adapted in accordance with the prediction gain $G_j$. As the predictor itself is identical at both encoder and decoder, the calculations of the estimate $\hat{x}_j(n)$ of a current sample $x_j(n)$ as well as the calculations and adaptation of the predictor coefficients are exactly the same as in the decoder. The only difference is that on the encoder side the prediction error has to be calculated to be fed to the quantiser. Taking the quantiser in MPEG-1 Layer I as an example, the samples are first scaled by the scalefactor, which is the maximum value of all samples in that block, and then quantised by a uniform scalar quantiser. When backward predictor is used the scalefactor comes from the prediction errors. However, the calculation of prediction errors requires quantised input samples and hence without quantised samples there are not all required prediction errors. To address this problem, two quantisation schemes may be used, for example, closed-loop and open-loop schemes. In the closed-loop scheme, prediction, bit allocation, scaling and quantisation are done in one common iteration loop. In the open-loop scheme, the scalefactors are estimated directly from the prediction errors.

Figure 3:
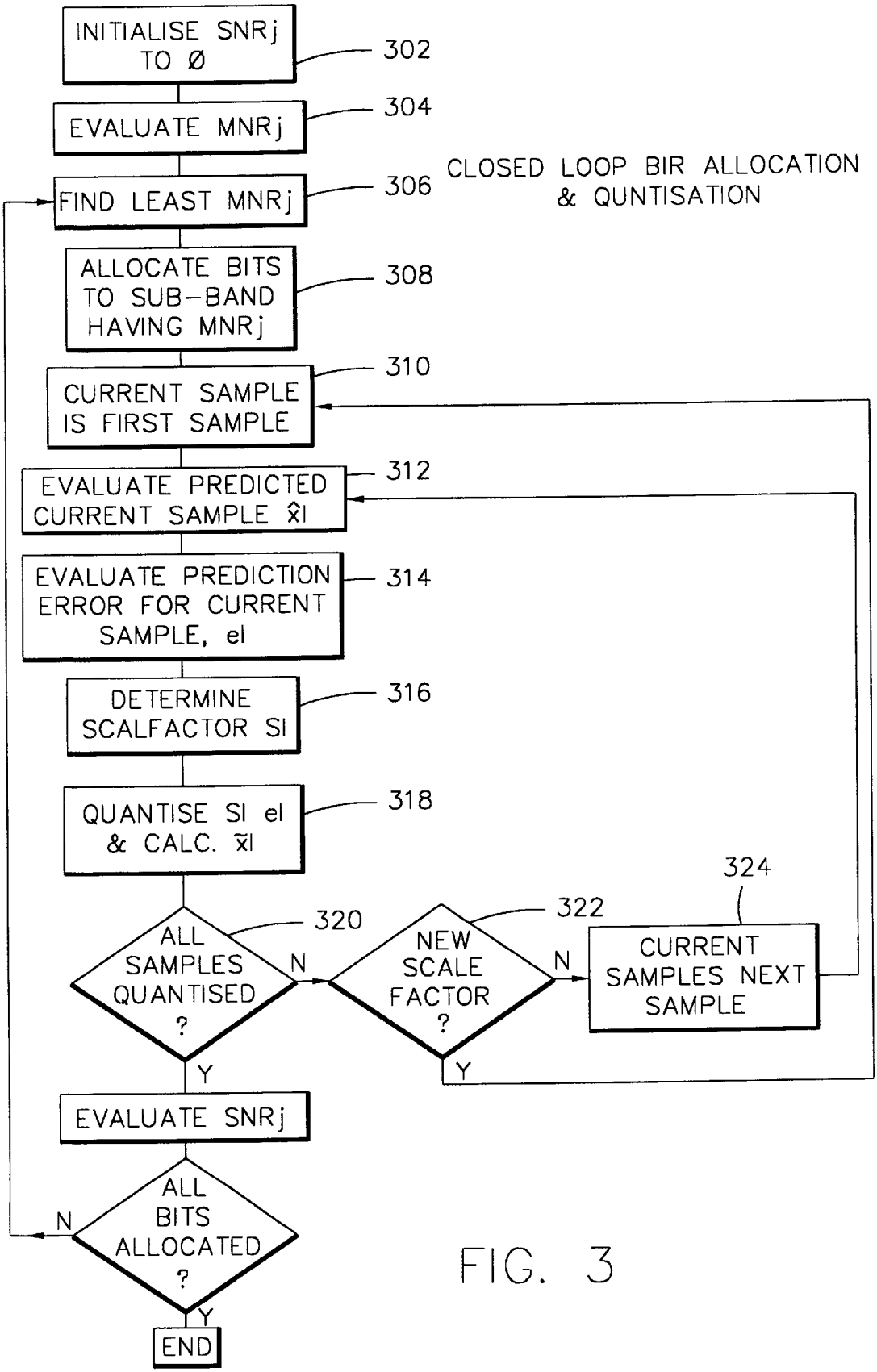
FIG. 3 shows a flow chart for close loop bit allocation and quantisation.

Referring now to FIG. 3, there is provided a flow chart showing relevant steps for the Dynamic Bit Allocator 700 in allocating bits to encode and quantise sub-band signal samples in cooperation with Backward Predictors 400, Scalefactor 500, and Quantiser 600 in a closed loop system. Machine readable instructions in accordance with the flow chart of FIG. 3 may be supplied to a microprocessor or digital signal processor thereby providing means for dynamically allocating bits.

The closed loop bit allocation begins at step 302 where the SNR for each sub-band block is initialised to zero. At step 304 the Mask to Noise Ratio (MNR) for each sub-band block is calculated in accordance with the following equation;

$$MNR_j = SNR_j - SMR_j \tag{7}$$

where $SNR_j$ is the SNR for the jth sub-band, SMR is the Signal to Mask Ratio for the jth sub-band block calculated by the Psychoacoustic Model 300 and $MNR_j$ is the MNR for the jth sub-band block. Once the MNR for each sub-band block has been calculated, it is determined, step 306 which sub-band block has the lowest mask to noise ratio $MNR_I$ (hereinafter referred to as the Ith sub-band).

At step 308 bits are allocated to encode each of the prediction error $e_I(n)$ in the Ith sub-band block, such that each prediction error has a further 1 bit allocated to it. For MPEG-1 this would require 12 bits since there are 12 samples per block. At step 310 the first sample is defined to be the current sample, and at step 312 the predicted value $\hat{x}_I$ for the current sample is calculated. This is obtained from quantised samples in the previous block. At step 314 the prediction error, $e_I$, for the current sample is calculated in accordance with the following equation;

$$e_I = x_I - \hat{x}_I \tag{8}$$

where $e_I$ is the prediction error for the current sample, $x_I$ is the current sample and $\hat{x}_I$ is the predicted value for the current sample.

For quantising the prediction error $e_I$ appropriate scale factor $s_I$ is used. However, scale factor $s_I$ is based on the greatest $e_I$ value in a block and therefore requires knowledge of prediction errors for later samples in the current block. Clearly, such information is not yet available so the scale factor is determined from what prediction errors are known for the current block, step 316. For the first sample this is simply taking the first sample prediction error $e_I$ as the scale factor. The first sample prediction error $e_I$ and scale factor $s_I$ are quantised at step 318, and the quantised sample $\tilde{x}_I(n)$ is calculated. The quantised sample is calculated in accordance with the following equation;

$$\tilde{x}_I = \tilde{e}_I + \sum_{i=1}^{N} a_{I,i}\tilde{x}_I(n-i) \tag{9}$$

where $\tilde{x}_I$ is current quantised sample, $\tilde{e}_I$ is prediction error for current sample $a_{I,i}$ is predictor coefficient for Ith sub-band, $\tilde{x}_I(n-i)$ is a previous quantised sample, and N is the predictor order.

At step 320, if all the samples in the current frame are not yet quantised then the flow chart proceeds to step 322 where it is determined how to choose the scale factor calculated at step 316 is a new scale factor. If YES, the process flow goes to step 310 where the iterative process re-starts with the current sample being the first sample in the current block. If decision at 322 is NO then the next sample in the current block is designated the current sample, step 324. The process flow then goes to step 312 where the predicted value for the new current sample is evaluated.

For all samples having been quantised, the decision at step 318 is YES and the process continues to step 324 where the SNR for the Ith sub-band is calculated in accordance with the following equation;

$$SNR_I = 10\log_{10}\left(\frac{\sum_{i=1}^{S_N} x_I^2(n+i)}{\sum_{i=1}^{S_N}(x_I(n+i)-\tilde{x}_I(n+i))^2}\right)(\text{dB}) \tag{10}$$

where $x_I(n+i)$ is the ith sample in the $I^{th}$ block and $\tilde{x}_I(n+i)$ is the ith quantised sample in the Ith block.

If all bits available for allocation have been allocated then a YES decision is taken at step 326 and the closed loop bit allocation and quantisation routine ends. A NO decision at step 326 results in the process returning to step 304 where a new MNR for the Ith sub-band is calculated and it is determined which sub-band block has the lowest $MNR_I$.

Referring now to FIG. 4, there is shown a flow chart describing an open-loop bit allocation and quantisation process suitable for use in a preferred embodiment of the invention. An open-loop search avoids the high computational complexity inherent in a closed-loop search. In the open-loop search any unquantised signal samples are substituted for corresponding quantised samples which are not yet available. Additionally, instead of the sub-band SNR being calculated, the prediction gain is calculated based on predicted signal samples.

At step 402 the prediction gain is evaluated in accordance with the following equation;

$$G_I = 10\log_{10}\left(\frac{\sum_{i=1}^{S_N} x_j^2(n+i)}{\sum_{i=1}^{S_N}(x_j(n+i)-\hat{x}_j(n+i))^2}\right)\text{(dB)} \tag{11}$$

where $x_j(n+i)$ is the ith sample in the jth sub-band, $\hat{x}_j(n+i)$ is the ith predicted sample in the jth sub-band and $S_N$ is the number of samples in a sample block. Then at step 404, the MNR for each sub-band is calculated in accordance with the following equation;

$$MNR_j = SNR_j - SMR_j - G_j \tag{12}$$

where $MNR_j$ is the mask to noise ratio $SMR_J$ is the signal to mask ratio and $SNR_j$ is the signal to noise ratio for jth sub-band and $G_j$ is the prediction gain for the jth sub-band, and the sub-band sample block having the lowest MNR ($MNR_I$) is identified. At step 406 bits are allocated for quantising prediction errors for the sample block having least MNR and, referred to as the Ith sample block. In an embodiment for MPEG each of the twelve samples in the Ith block has one extra bit allocated to it for quantising the sample prediction error $e_I(n+i)$. At step 408 it is determined if all available bits have been allocated. If all the bits have not been allocated then the process returns to step 404. The procedure continues until all bits have been allocated. Once all the bits are allocated the procedure ends at step 410.

Using the bit allocation information, prediction errors can be quantised directly. The scale factors are calculated during the closed loop method described above.

The applicant has found that the open-loop process provides bit allocation close to the optimal obtained using the closed-loop process, but with significantly reduced computational complexity.

In an exemplary embodiment of the invention, use of backward prediction is controlled on a block by block basis, and sub-band block by sub-band block basis. Referring to FIG. 2 there is provided a Predictor Switch 900 for carrying out predictor control. The Predictor Switch 900 is operable to detect transients in the audio signal and to invoke a lower order prediction routine to handle and recover from such transients. Typically, Predictor Switch 900 is adapted to operate in accordance with the flow chart shown in FIG. 5.

In loop 502 the prediction gain for each sub-band block is calculated for all 32 sub-bands. At step 504 the sum of individual sub-band prediction gains is calculated to give the total block prediction gain, $G_T$. At step 506 it is determined if the total block prediction gain, $G_T$, is greater than a threshold prediction gain, $G_{TH}$ for the block. If $G_T$ is greater than $G_{TH}$ then the prediction process continues, but if $G_T$ less than $G_{TH}$ then a transient is indicated. Typically, $G_{TH}$ is 20 dB, but may be adjusted according to the number of sub-bands employed in an embodiment of the invention or according to experimentation. Optionally, step 506 may comprise a test for a sudden drop in prediction gain as shown in the following equation;

$$|G_T - G_{previous}| < G_{TH}' \tag{13}$$

where $G_{previous}$ is the total gain for the previous block and $G_{TH}'$ is the difference threshold.

If the decision is YES at step 506 then prediction will be utilised for that block, step 508. That is to say, high order prediction continues, or the transient recovery stepped prediction sequence is continued. However, if the decision is NO then the process goes to step 510 where the predictor for each sub-band is initialised for low order prediction, and the procedure reverts to the loop 502 whereby the low order prediction sub-routine is activated. From steps 508 and 510, the process proceeds to loop 502 where the predictor switch is initialised ready for the next block.

Figures 6, 8:
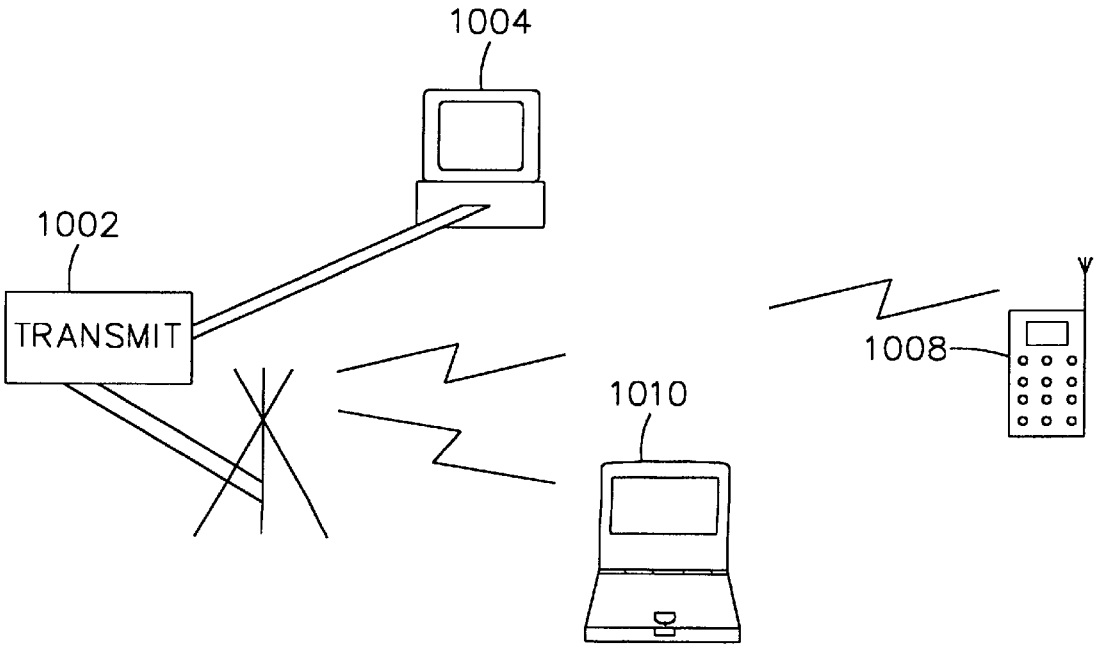
FIG. 6 shows low order prediction sub-routine prediction order sequence.
FIG. 8 shows a typical communication network operable in accordance with the present invention.

A table for a low-order predictor sub-routine 510 is shown in FIG. 6. Sub-routine 510 is operable for each sub-band for which low-order prediction is to be used. When it is determined on a block basis that low-order prediction is to be used then sub-routine 510 is used for all sub-band predictors. If prediction is to be used on a block basis, then sub-routine 510 is only used for those sub-bands identified at step 502 for low-order prediction.

Sub-routine 600 is described by Table 1 shown in FIG. 6. If a transient is detected by Predictor Switch 900 (FIG. 2), then sub-routine 510 initiated. For the frame or block containing the prediction of order 0, the predictors are switched off. As is shown in FIG. 6, for Num-frame=1 the prediction order is 20 and the analysis window has a data length of 40. For subsequent frames up to Num-frame=9 the prediction order and analysis data length are increased as shown in Table 1. The normal algorithm utilizing equation (5) is used for Num-frame 1–8. For Num-frame=9 the predictor order is 50 and the recursive LD-CELP algorithm is employed having a window function given by equation (6) operating on autocorrelation function given by equation (5). This is the normal operation mode for the predictors.

The applicant has observed that switching to low-order prediction based on short segments of data for the occurrence of transients improves prediction gain over that obtained for high-order prediction during transients. Stepping up prediction order and data length during sub-routine 510 as shown in FIG. 6 recovery from transients may be improved, and a return to normal high-order prediction achieved relatively promptly.

As will be clear to a person skilled in the art, it will be necessary to contain information regarding predictor order and data length in the signal transmitted to a receiver in order that the receiver can decode the signal and reconstruct the original audio signal.

Predictor control information is included in side information which is transmitted with the actual encoded signal. The side information includes a frame prediction bit which indicates if prediction is being used (bit set) or not used (bit set 1) in the current frame. This bit is always present. If the bit is set 1 then prediction is switched off for the current frame and no further predictor side information is present. If the bit is set 0 then prediction is used for the current frame, and for each sub-band there is one bit which controls use of prediction in that sub-band. If the sub-band predictor bit is set 1 then low-order prediction is initiated for that sub-band, and the receiver enters sub-routine 510 described with reference to FIG. 6. If the sub-band predictor is set 0 then normal high order prediction continues. In the foregoing manner, the receiver Backward Predictor corresponding to the transmitter Backward Predictor can decode the signal to produce a corresponding audio signal.

Typically, the scalefactors constitute the largest side information in the audio codec. Each sub-band requires six bits to represent the scalefactor if a sample prediction error is to be transmitted or that sub-band. However, scalefactors between successive frames are highly correlated. The scalefactors may be coded to take advantage of this time redundancy by means of predictive coding. In closed-loop quantisation, for example, the optimal scalefactor and the corresponding SNR are obtained first. The scalefactor for the previous frame is then tested in the present frame. If the corresponding SNR using the previous frame's scalefactor is comparable to the SNR using the optimal scalefactor obtained during closed-loop quantisation for the present frame, i.e., $$SNR^{previous} > SNR^{present} - C(dB)$$

where C is the improvement in SNR achievable by using the bits for scale factoring in encoding the prediction error, the scalefactor in the present frame will not be transmitted. Otherwise the new scalefactor is sent to the receiver.

If the previous scale factor is to be used, all that needs to be transmitted is a single bit (set 1) indicating that the previous scale factor is to be transmitted. This leaves bits spare which can be used to improve the SNR of the present signal. For example, in MPEG-1 Layer I, C can be set to be 3 dB. Only 1 bit additional side information is needed to indicate whether the scalefactor is sent or not.

In MPEG-1 Layer I, bit allocation information require 128 bits side information, 4 bits for each sub-band. In Layer II, the side information is reduced depending on the sampling frequency and bitrates. In an embodiment of the present invention an adaptive scheme is used for bit allocation, specifically taking the consideration of low bitrate coding. To take account of this, firstly 4 bits are used to indicate the number of sub-bands in which no bits are allocated starting from the highest frequency band. Secondly, since the number of bits used in each sub-band is typically different, the bit allocation information is different for the sub-bands. For example, for the first ten sub-bands, 3 bits are used to represent 7 possible number of bits for quantising the samples in that sub-band. In the rest of the sub-bands, 2 bits are used to represent four possibilities. Experimental results show that using this bit allocation strategy, bit allocation side information is reduced to about 40 bits instead of 128 bits without any significant performance decrease.

In view of the foregoing description it will be evident to a person skilled in the art that various modifications may be made within the scope of the invention. For example, it may be possible to switch prediction order for individual sub-bands. Additionally, the transient recovery mode described with reference to FIG. 6 may be varied in terms of prediction order and data length.

Figure 7:
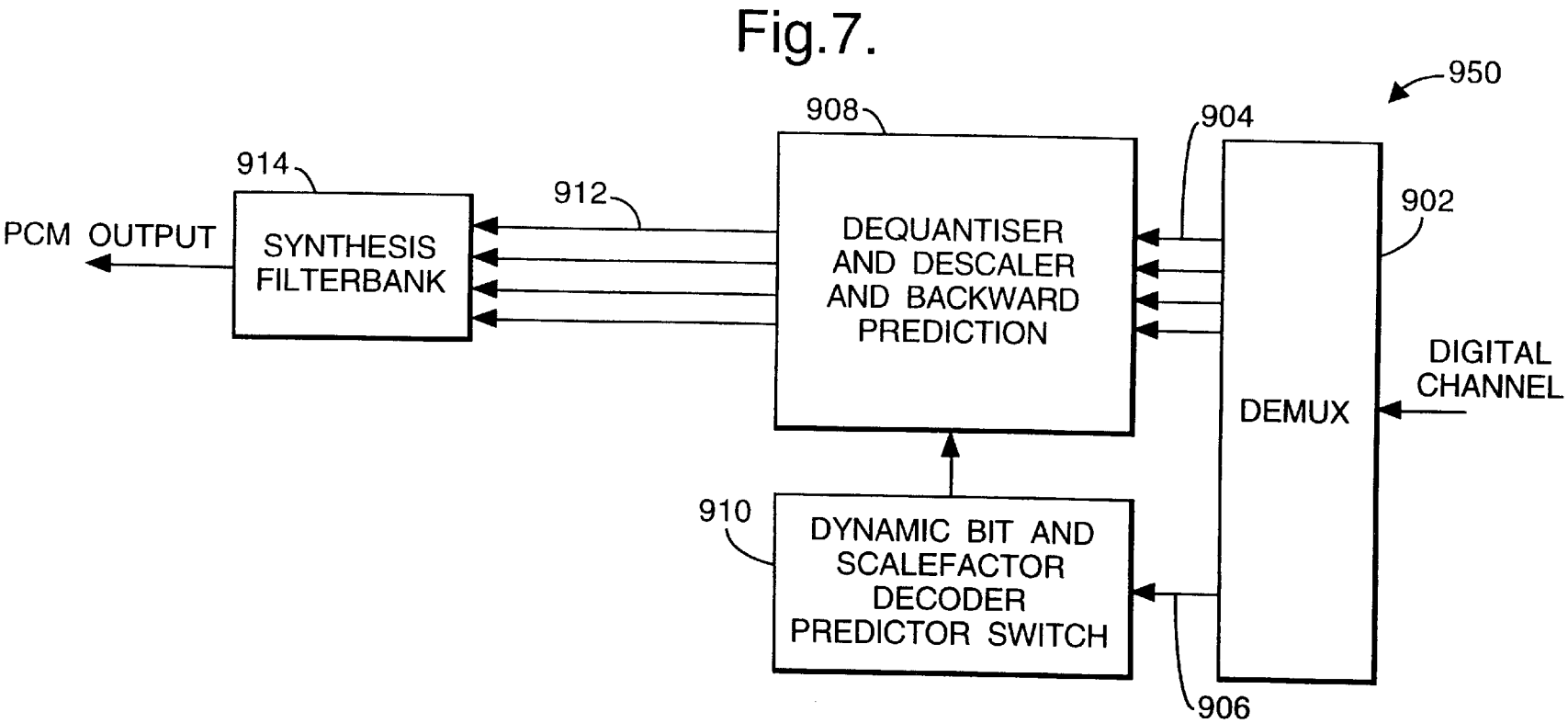
FIG. 7 shows a schematic diagram of an audio decoder in accordance with the present invention.

An audio decoder 950 suitable for use with an embodiment of the invention is now described with reference to FIG. 7. Signals from a digital channel in, for example, MPEG format are input to demultiplexor 902. Demultiplexor 902 forwards prediction error signals for respective sub-bands 904 to dequantiser, descaler and backward predictor 908. Side information at 906 such as bit allocation, scale factor and predictor switch information are forwarded to dynamic bit and scale factor decoder and predictor switch 910. The backward predictor in 908 comprises the same algorithm as used for audio encoding in backward predictor 400. The prediction order used in 908 is dependent upon the information provided by predictor switch 910. If predictor switch 910 is indicated that a low order mode has been initiated then the backward predictor in 908 functions in accordance with the table shown in FIG. 6. If the high order mode is current then the backward predictor in 908 operates with a high prediction order. The dequantised descaled and backward predicted signals respective sub-bands 912 are output to filter bank 914 where the signal is reconstructed. Filter bank 914 performs a substantially inverse operation to filter bank 200 described with reference to FIG. 1. Filter bank 914 outputs a PCM output to what may be a conventional audion circuit.

FIG. 8 shows a communications network operable in accordance with embodiments of the present invention. A transmission unit 1002, comprising an audio encoder in accordance with the present invention may be coupled via a landline connection to a computer 1004, that computer having a decoder in accordance with the present invention. Optionally, computer 1004 may be part of a local area network where a single computer decodes input signals into a local data format for distribution on the local area network. Transmission unit 1002 may also forward information to base station 1006 of a radio communication network for example. Optionally base station 1006 may comprise an encoder in accordance with the present invention, or the data may already be encoded in transmission unit 1002. Signals from base station 1006 may be received by a radio telephone 1008 or a mobile computer system 1010. Radio telephone 1008 and mobile computer 1010 comprise a decoder in accordance with the present invention.

Figure 9:
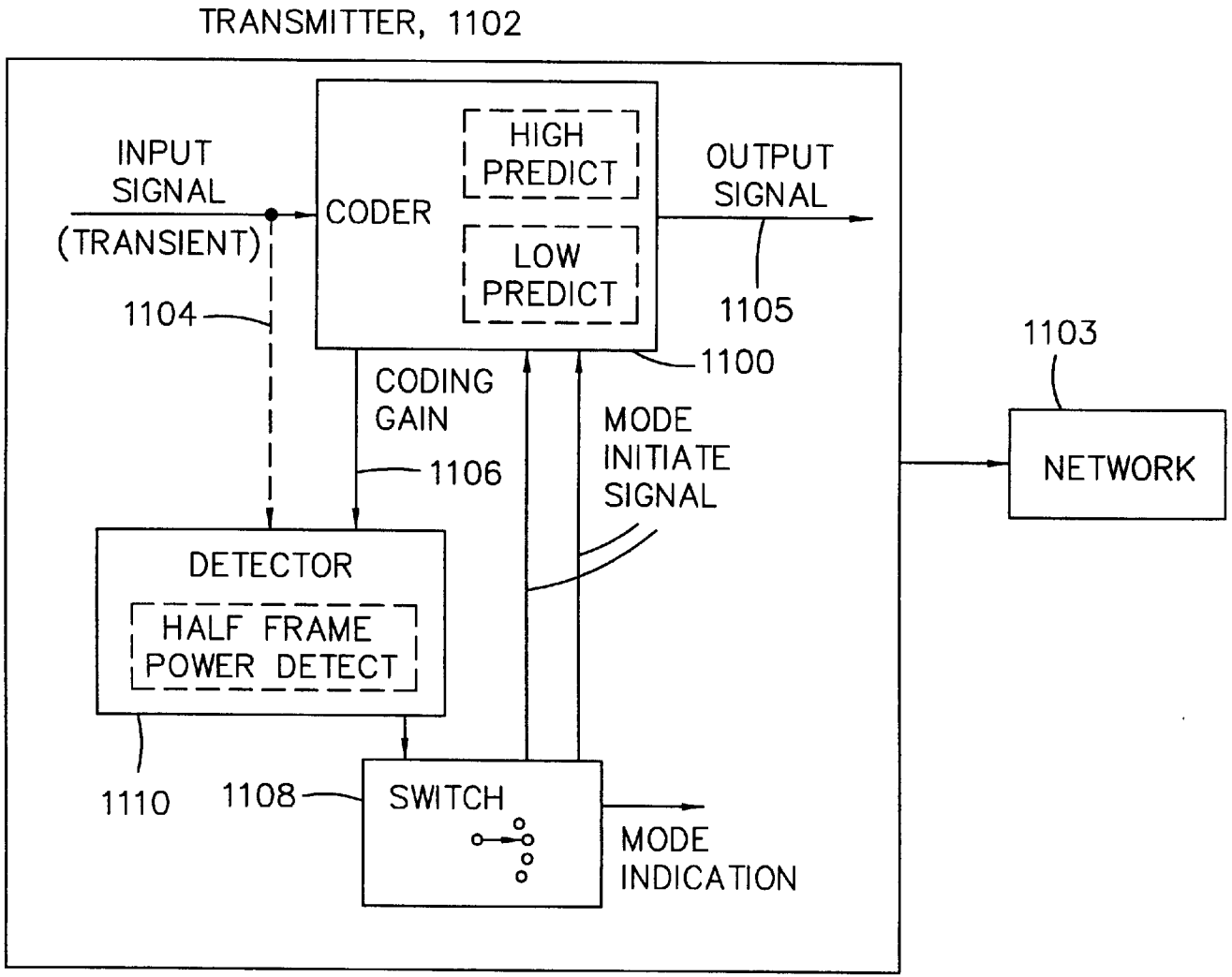
FIG. 9 is a block diagram showing switching of high and low orders of prediction in a coder.

FIG. 9 shows diagrammatically the operation of the invention with respect to the coder, described herein above, and indicated at 1100. The coder 1100 is part of a transmitter 1102 which communicates with a network 1103. The coder 1100 operates upon an input signal on line 1104, and is operative at a high order prediction mode and a low order prediction mode resulting in the outputting of an encoded signal on line 1105 and a predictive coding gain on line 1106. The order of the prediction mode is selected by mode initiate signals outputted by a switch 1108 in response to an output of a detector 1110. The detector 1110 is responsive to the coding gain on line 1106 to obtain information useful in the control of the switch 1108 to produce the mode initiation signals and also a mode indication signal. Optionally, the input signal line 1104 maybe connected to the detector 1110, as indicated by the dashed line, and the detector 1110 is operative to perform, for example, a half-frame power detection of the input signal to obtain information useful in the control of the switch 1108 to produce the mode initiation signals and the mode indication signal. When the detector 1110 detects a transient signal on line 1104, as by means of analysis of the coding gain or by the half-frame power detection, the switch 1108 is switched to produce a second mode initiation signal.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What I claim is:

1. An encoder comprising:

a predictive coder for encoding electronic signals input thereto, the predictive coder being operable for a first high prediction order mode and for a second lower prediction order mode, wherein the predictive coder is operable in the first and second modes in dependence on an input electronic signal comprising a transient signal; and the predictive coder is adapted in the second mode to be operative at a first low prediction order for the input electronic signal and subsequently increasingly higher prediction orders for subsequent input electronic signals.

2. An encoder according to claim 1, wherein the predictive coder is selectable to initiate the second mode for the input electronic signal comprising a transient signal.

3. An encoder according to claim 1, wherein the prediction order is increased up to the first high prediction order.

4. An encoder according to claim 3, wherein the predictive coder is further adapted such that the first mode becomes operative for the prediction order in the second mode being the first high prediction order.

5. An encoder according to claim 1, further comprising a transient signal detector for detecting a transient signal.

6. An encoder according to claim 5, wherein the transient signal detector is adapted to determine a difference in predictive coding gain for sequential input electronic signals exceeding a predetermined threshold.

7. An encoder according to claim 5, wherein the transient signal detector is adapted to determine predictive coding gain exceeding a predetermined threshold.

8. An encoder according to claim 1, yet further comprising a filter for providing electronic signals categorized into respective sub-bands to corresponding respective predictive coders.

9. A transmitter comprising an encoder according to claim 1, and further comprising means for transmitting electronic signals indicating initiation of the second mode for the predictive coding means.

10. A decoder comprising:

a predictive coder for decoding electronic signals input thereto, the predictive coder being operable for a first high prediction order mode and for a second lower prediction order mode, wherein the predictive coder is operable in the first and second modes responsive to a second mode initiate signal input thereto; and the predictive coder is adapted in the second mode to be operative at a first low prediction order for an input electronic signal and subsequently increasingly higher prediction orders for subsequent input electronic signals.

11. A decoder according to claim 10, wherein the predictive coder is selectable to initiate the second mode for the second mode initiate signal input thereto.

12. A receiver comprising a decoder according to claim 10, and further comprising means for receiving the second mode initiate signal.

13. A method for encoding electronic signals, comprising predictive coding input electronic signals in a first mode having a high prediction order, detecting an input electronic signal comprising a transient signal, and initiating predictive coding input electronic signals in a second mode having a lower prediction order for detection of an input electronic signal comprising a transient signal; wherein the second mode comprises operation at a first low prediction order for the input electronic signal and subsequently increasingly higher prediction orders for subsequent input electronic signals.

14. A method for decoding electronic signals, comprising predictive coding input electronic signals in a first mode having a high prediction order, detecting a second mode initiate signal, and initiating predictive coding of input electronic signals in a second mode having a lower prediction order in response to the second mode initiate signal; wherein the second mode comprises operation at a first low prediction order for an input electronic signal and subsequently increasingly higher prediction orders for subsequent input electronic signals.

15. A communication network, comprising:

a transmitter comprising an encoder, said encoder comprising a predictive coder for encoding signals input thereto, the predictive coder being operable for a first high prediction order mode and for a second lower prediction order mode, wherein the predictive coder is operable for the first and second modes in dependence on an input electronic signal comprising a transient signal, said communication network further comprising means for transmitting electronic signals indicating initiation of the second node for the predictive coder, wherein said communication network further comprises a receiver comprising a predictive decoder for decoding electronic signals input thereto, the predictive decoder being operable for a first high prediction order mode and for a second lower prediction order mode, wherein the predictive decoder is operable for the first and second modes responsive to a second mode initiate signal input thereto, said receiver further comprising means for receiving the second mode initiate signal, wherein the predictive decoder is operative in the second mode at a first low prediction order for the input electronic signal and subsequently increasingly higher prediction orders for subsequent input electronic signals.

16. A communication network according to claim 15, comprising a radio telephone network having a base station for communication with a radio telephone.

17. A method for encoding an electronic signal, comprising the steps of:

encoding an input electronic signal by use of predictive coding means;

operating the predictive coding means in a first mode having a high prediction order, and operating the predictive coding means in a second mode having a low prediction order;

detecting in the input electronic signal a transient signal; and in response to a detection of the presence of the transient signal, selecting one of said first and said second modes for operation of said predictive coding means, wherein, after operation at a lower prediction order mode, operation proceeds through subsequently increasingly higher prediction orders for subsequent input electronic signals.

18. A method according to claim 17 wherein, in said operating of said predictive coding means in the first mode, said predictive coding means is operated as a backward predictor.

19. An encoder for encoding an electronic signal, comprising:

predictive coding means for encoding an input electronic signal;

means for selecting an operation of the predictive coding means to be in a first mode having a high prediction order, and in a second mode having a low prediction order;

means for detecting in the input electronic signal a transient signal; and wherein, in response to a detection of the presence of the transient signal, said selecting means is operative to select one of said first and said second modes for operation of said predictive coding means, wherein, after operation at a lower prediction order mode, operation proceeds through subsequently increasingly higher prediction orders for subsequent input electronic signals.

20. An encoder according to claim 19 wherein, in said operation of said predictive coding means in the first mode, said predictive coding means is operating as a backward predictor.

* * * * *